US008256143B2

(12) United States Patent
Flannery

(10) Patent No.: US 8,256,143 B2
(45) Date of Patent: Sep. 4, 2012

(54) ARTICLE OF FOOTWEAR INCLUDING IMPROVED LACE KEEPER

(75) Inventor: William J. Flannery, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 445 days.

(21) Appl. No.: 12/611,457

(22) Filed: Nov. 3, 2009

(65) Prior Publication Data

US 2011/0099844 A1 May 5, 2011

(51) Int. Cl.
*A43B 23/26* (2006.01)

(52) U.S. Cl. ..... 36/54; 36/50.1

(58) Field of Classification Search ..... 36/54, 50.5, 36/50.1

See application file for complete search history.

(56) References Cited

U.S. PATENT DOCUMENTS

| | | | | | |
|---|---|---|---|---|---|
| 509,707 | A | * | 11/1893 | Vachon | 24/712.1 |
| 749,569 | A | * | 1/1904 | Luks | 24/712.7 |
| 858,681 | A | | 7/1907 | Thomas | |
| 1,419,199 | A | | 6/1922 | Badich | |
| 2,007,157 | A | * | 7/1935 | Cockrum | 24/713.4 |
| 3,193,950 | A | | 7/1965 | Liou | |
| 4,053,995 | A | * | 10/1977 | Shein | 36/88 |
| 4,142,307 | A | | 3/1979 | Martin | |
| 4,200,998 | A | | 5/1980 | Adams | |
| 5,333,398 | A | | 8/1994 | Seo | |
| 5,430,960 | A | * | 7/1995 | Richardson | 36/89 |
| 6,158,096 | A | | 12/2000 | Bar | |
| 6,775,928 | B2 | | 8/2004 | Grande et al. | |
| 6,952,890 | B1 | | 10/2005 | Blakeslee | |
| 7,117,616 | B2 | | 10/2006 | Hull | |
| 7,685,739 | B2 | * | 3/2010 | Aveni et al. | 36/8.3 |
| 7,823,298 | B2 | * | 11/2010 | Nishiwaki et al. | 36/88 |
| 2003/0226284 | A1 | | 12/2003 | Grande et al. | |
| 2006/0143949 | A1 | * | 7/2006 | Wiper | 36/50.1 |
| 2006/0162190 | A1 | * | 7/2006 | Nishiwaki et al. | 36/97 |
| 2007/0068040 | A1 | | 3/2007 | Farys | |
| 2007/0227045 | A1 | * | 10/2007 | Aveni et al. | 36/54 |
| 2008/0307673 | A1 | * | 12/2008 | Johnson | 36/50.1 |
| 2009/0277043 | A1 | * | 11/2009 | Graser et al. | 36/91 |
| 2010/0269369 | A1 | * | 10/2010 | Nishiwaki et al. | 36/28 |
| 2011/0099843 | A1 | * | 5/2011 | Jung | 36/50.1 |

FOREIGN PATENT DOCUMENTS

WO WO 9806288 A1 * 2/1998

OTHER PUBLICATIONS

International Search Report dated Oct. 20, 2010, International Application No. PCT/US2010/047123, International Filing Date Aug. 30, 2010.

Written Opinion dated Oct. 20, 2010, International Application No. PCT/US2010/047123, International Filing Date Aug. 30, 2010.

* cited by examiner

*Primary Examiner* — Marie Patterson

(74) *Attorney, Agent, or Firm* — Harness, Dickey & Pierce, P.L.C.

(57) ABSTRACT

An article of footwear is provided and includes a sole structure and an upper structure attached to the sole structure. The upper structure includes a vamp separated into medial and lateral portions, a tongue, and a lace. The tongue includes a main body portion and a first lace-retention feature attached to the main body portion. The main body portion has a first end attached to the medial and lateral portions, a second end that is moveable relative to the upper structure, and a longitudinal axis extending between the first end and the second end. The first lace-retention feature includes a first opening that receives the lace in a first direction substantially parallel to the longitudinal axis.

21 Claims, 3 Drawing Sheets

ARTICLE OF FOOTWEAR INCLUDING IMPROVED LACE KEEPER

FIELD

The present disclosure relates to footwear and more particularly to an article of footwear including a tongue having a lace-keeping feature that maintains a desired position of the tongue relative to a foot of a user.

BACKGROUND

This section provides background information related to the present disclosure which is not necessarily prior art.

Conventional footwear typically includes a tongue that protects a top surface of a foot when the foot is inserted into the article of footwear. The tongue is typically disposed between laces of the article of footwear and the top surface of the foot to prevent the laces from rubbing against and causing discomfort to the foot during use. Conventional tongues provide optimum protection and comfort for the foot when centered relative to medial and lateral sides of the article of footwear.

Conventional tongues typically migrate from a centered location relative to the medial and lateral sides of the article of footwear to the lateral side of the article of footwear during use. Movement of the tongue to the lateral side of the article of footwear is further exacerbated when the article of footwear is used during athletic activities such as, for example, running or jogging and the like.

SUMMARY

This section provides a general summary of the disclosure, and is not a comprehensive disclosure of its full scope or all of its features.

A tongue for an article of footwear is provided. The article of footwear includes an upper structure having a vamp separated into medial and lateral portions. The tongue includes a main body portion and a lace-retention feature, whereby the main body portion has a first end attached to the medial and lateral portions, a second end that is movable relative the upper structure, and a longitudinal axis extending between the first end and the second end. The first lace-retention feature is attached to the main body portion and includes a first opening operable to receive a lace in a first direction substantially parallel to the longitudinal axis.

An article of footwear is provided and includes a sole structure and an upper structure attached to the sole structure. The upper structure includes a vamp separated into medial and lateral portions, a tongue, and a lace. The tongue includes a main body portion and a first lace-retention feature attached to the main body portion. The main body portion has a first end attached to the medial and lateral portions, a second end that is moveable relative to the upper structure, and a longitudinal axis extending between the first end and the second end. The first lace-retention feature includes a first opening operable to receive the lace in a first direction substantially parallel to the longitudinal axis.

A method of making a tongue for an article of footwear including an upper structure having a vamp separated into medial and lateral portions is provided. The method includes attaching a first end of a main body portion to the medial and lateral portions, whereby the main body portion includes a second end that is movable relative the upper structure and a longitudinal axis extending between the first end and the second end. The method further includes attaching a first lace-retention feature to the main body portion and passing a lace through a first opening of the first lace-retention feature in a first direction substantially parallel to the longitudinal axis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 2:
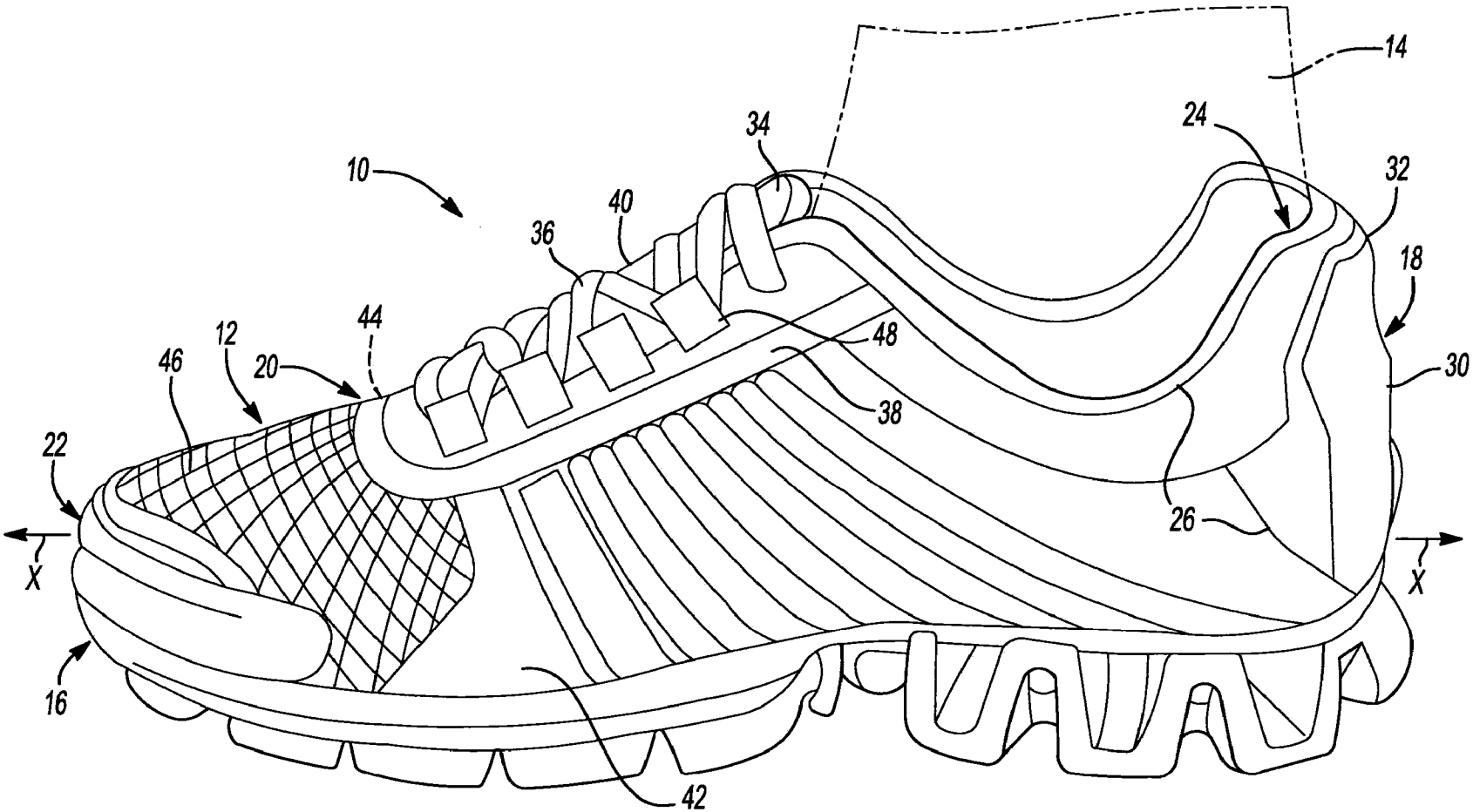
FIG. 2 is a side view of the article of footwear of FIG. 1.

With reference to the figures, an article of footwear 10 is provided and includes an upper structure 12 that selectively receives a foot 14 (FIG. 2) of a user and a sole structure 16 providing support and cushioning to the foot 14 during use.

The upper structure 12 includes a rear 18, a vamp 20, a toe box 22, and a liner 24, which are joined together through stitching 26, high-frequency welding, and/or via an epoxy. The upper structure 12 is fastened to the sole structure 16 for securely retaining the foot 14 and may be formed of a material that concurrently protects the foot 14 and provides ventilation for cooling and removing perspiration.

The rear 18, or back portion of the article of footwear 10, protects the wearer's calcaneus or heel bone and minimizes relative movement between the foot 14 and the article of footwear 10 during use. To this end, the rear 18 may include a heel counter 30 providing stiffening properties for the rear of the article of footwear 10 and a topline 32 for bringing the rear 18 into contact with the foot 14.

Figure 1:
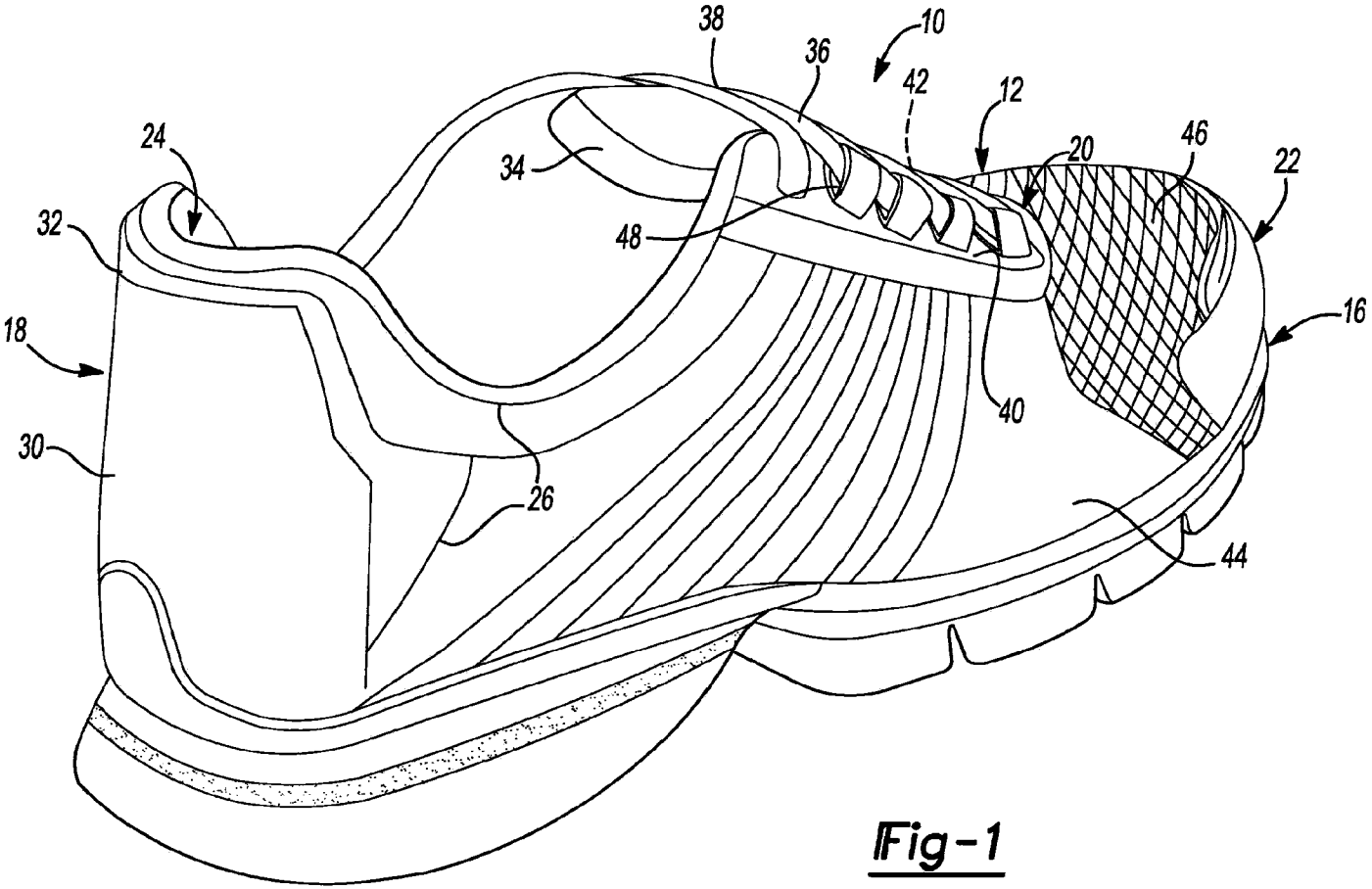
FIG. 1 is a perspective view of an article of footwear in accordance with the teachings of the present disclosure.

The vamp 20 generally covers the instep and toes of the foot 14 and further includes a tongue 34 and a lace 36. The vamp 20 is typically separated into a medial portion 38 (FIG. 2) and a lateral portion 40 (FIG. 1), which correspond to the medial and lateral sides 42, 44 of the article of footwear 10. As shown, the vamp 20 is made from a variety of materials such as leather and synthetic materials, which are strategically placed for both functional and aesthetic purposes. For example, in one construction, a synthetic mesh material 46 is placed over a front portion of the foot 14 to allow air to move into and out of the article of footwear 10 to cool the foot 14 during use.

The tongue 34 is disposed generally between the medial and lateral portions 38, 40 and may be formed from the same or different material as the medial and lateral portions 38, 40. The tongue 34 improves the overall aesthetics of the article of footwear 10 and protects a top portion of the foot 14 by preventing the lace 36 from rubbing against the top portion of the foot 14.

The lace 36 extends through opposing lacing holes 48 formed in or attached to the upper structure 12 and draws the medial and lateral portions 38, 40 of the vamp 20 towards one another for securing the vamp 20 around the foot 14. The toe box 22 covers and protects the front portion of the foot 14 and may be formed from a relatively durable material to protect the upper structure 12 from scuffing and to protect the front portion of the foot 14 during use.

The liner 24 is disposed generally within an interior portion of the article of footwear 10 and is positioned such that when the foot 14 is received within the article of footwear 10, the liner 24 is in direct contact with portions of the foot 14. The liner 24 is constructed from a generally soft material and is formed over a layer of cushioning material to concurrently provide the foot 14 with a degree of comfort and protection during use.

Figure 3:
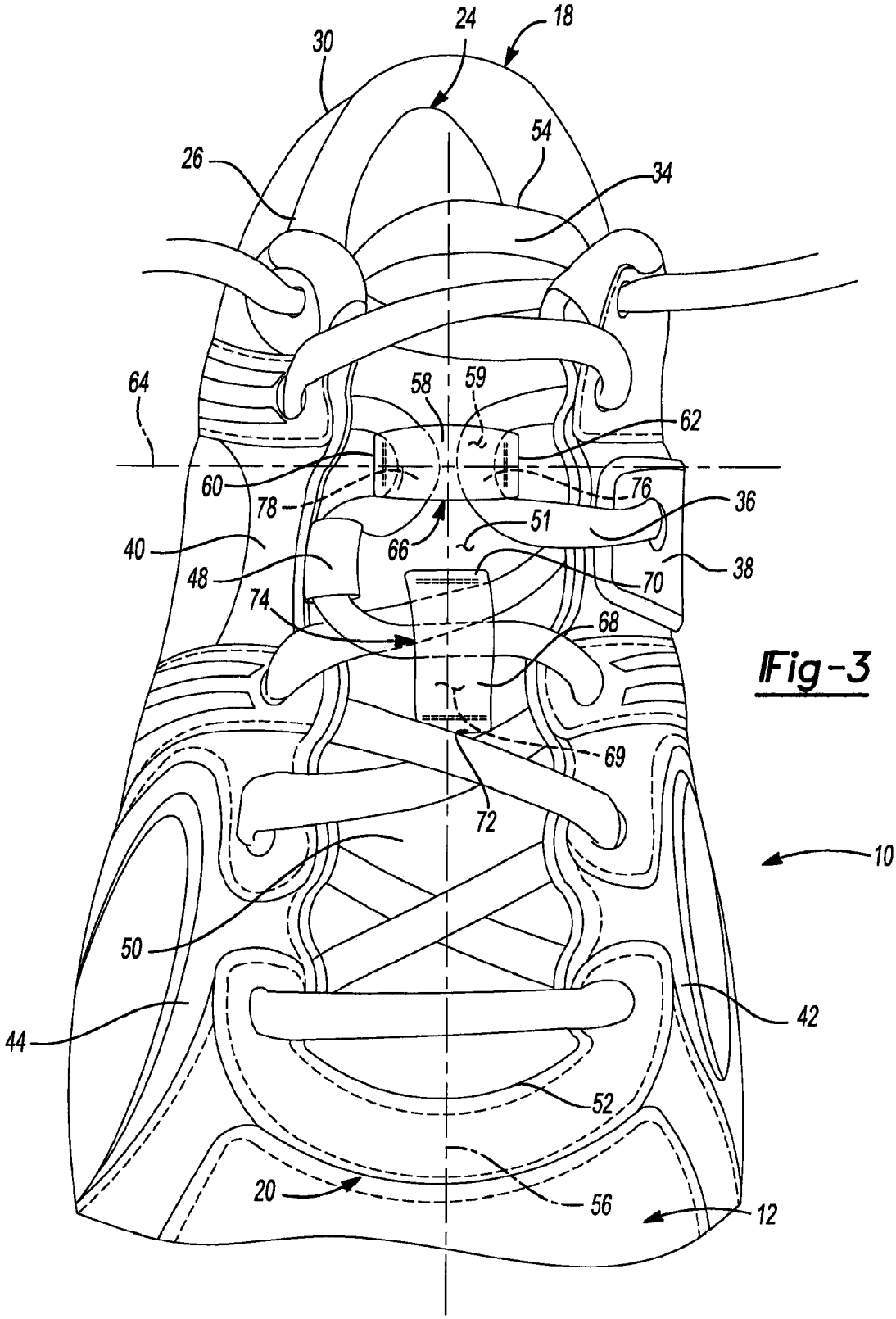
FIG. 3 is a top view of the article of footwear of FIG. 1.

With particular reference to FIG. 3, the tongue 34 has a generally rectangular main body portion 50 with a first end 52 and a second end 54. The first end 52 is attached to the medial and lateral portions 38, 40 of the vamp 20 and the second end 54 is movable relative to the upper structure 12. The length of the main body portion 50 extends along a longitudinal axis 56, which extends between the first end 52 and the second end 54.

The tongue 34 further includes a horizontal lace-retention feature 58 located proximate the longitudinal axis 56. The lace-retention feature 58 is generally rectangular with a pair of outboard ends 60, 62 attached to the main body portion 50 of tongue 34 by any suitable means such as stitching, high-frequency welding, and/or via an epoxy. The length of the lace-retention feature 58 extends along a latitudinal axis 64 of the main body portion 50. Attaching the outboard ends 60, 62 to the main body portion 50 forms a horizontal opening 66 between a top surface 51 of the tongue 34 and an inner surface 59 of the lace-retention feature 58 that accepts the lace 36 therethrough in a direction substantially parallel to the longitudinal axis 56.

A vertical lace-retention feature 68 is attached to the tongue 34 below the horizontal lace-retention feature 58 in a similar fashion to that of the horizontal lace-retention feature 58. The lace-retention feature 68 is generally rectangular with a pair of outboard ends 70, 72 and has a length extending along the longitudinal axis 56. The lace-retention feature 68 forms a vertical opening 74 between the top surface 51 of the tongue 34 and an inner surface 69 of the lace-retention feature 68 that accepts the lace 36 therethrough in a direction substantially parallel to the latitudinal axis 64.

The lace 36 is strung through the lacing holes 48 and the lace-retention features 58, 68 to maintain the tongue 34 in an upright and centered position relative to the medial and lateral portions 38, 40. The lace 36 extends from the lacing holes 48 on the medial side 42 in the general direction of the latitudinal axis 64 and through the vertical opening 74 of the lace-retention feature 68 to the lacing holes 48 on the lateral side 44. Likewise, the lace 36 extends from the lacing holes 48 on the lateral side 44 through the vertical opening 74 of the lace-retention feature 68 to the lacing holes 48 on the medial side 42.

A generally arcuate portion 76 of the lace 36 extends from the lacing holes 48 on the medial side 42 upward through the horizontal opening 66 of the lace-retention feature 58 and returns to the lacing holes 48 on the medial side 42. Likewise, a generally arcuate portion 78 of the lace 36 extends from the lacing holes 48 on the lateral side 44 upward through the horizontal opening 66 of the lace-retention feature 58 and returns to the lacing holes 48 on the lateral side 44. The horizontal opening 66 is oriented such that the arcuate portions 76, 78 do not overlap. Rather, the arcuate portions 76, 78 oppose one another in an area of the horizontal opening 66.

The interface between the lace-retention feature 58 and the portions 76, 78 functions to keep the tongue 34 centered. Specifically, the lace 36 cooperates with adjacent lacing holes 48 and with the lace-retention feature 58 to prevent movement of the tongue 34 relative to the medial and lateral portions 38, 40 by transmitting a force applied to the tongue 34 (in a direction substantially parallel to axis 64) to the respective portion 38, 40. By positioning the arcuate portions 76, 78 in opposition to one another, any force applied to the tongue 34 in either direction along axis 64 will be transmitted to the medial or lateral portion 38, 40 via interaction between the lace 36, adjacent lacing holes 48, and lace-retention feature 58 and, as such, will restrict movement of the tongue 34 relative to the medial and lateral portions 38, 40. The lace-retention feature 58 acts against the portions 76, 78 to prevent the tongue 34 from moving toward the lateral and medial sides 44, 42, respectively.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear comprising:

an upper structure including a vamp separated into a medial portion and a lateral portion;

a lace operable to selectively draw said medial portion and said lateral portion toward one another;

a tongue attached to said upper structure and including a longitudinal axis and a main body having an inner surface opposing the foot of a user during use and an outer surface formed on an opposite side of said main body than said inner surface and opposing said lace;

a first lace-retention feature attached to said main body and defining a first opening formed between said first lace-retention feature and said outer surface, said first opening receiving said lace in a first direction substantially parallel to a longitudinal axis of said tongue; and a second lace-retention feature attached to said main body and defining a second opening formed between said second lace-retention feature and said outer surface, said second opening receiving said lace in a second direction substantially perpendicular to said longitudinal axis of said tongue.

2. The article of footwear of claim 1, wherein a first portion of said lace extends from said medial portion through said first opening and returns to said medial portion and a second portion of said lace extends from said lateral portion through said first opening and returns to said lateral portion.

3. The article of footwear of claim 2, wherein said first portion is spaced apart and separated from said second portion within said first opening.

4. The article of footwear of claim 2, wherein a third portion of said lace extends from said medial portion through said second opening and is received by said lateral portion and a fourth portion extends from said lateral portion through said second opening and is received by said medial portion.

5. The article of footwear of claim 4, wherein said third portion crosses said fourth portion within said second opening.

6. The article of footwear of claim 1, wherein a third portion of said lace extends from said medial portion through said second opening and is received by said lateral portion and a fourth portion extends from said lateral portion through said second opening and is received by said medial portion.

7. The article of footwear of claim 1, wherein said main body includes a first end attached to said vamp and a second end that is movable relative to said vamp.

8. The article of footwear of claim 7, wherein said first lace-retention feature is disposed between said second end and said second lace-retention feature.

9. The article of footwear of claim 7, wherein said second lace-retention feature is disposed between said first end and said first lace-retention feature.

10. An article of footwear comprising:

an upper structure including a vamp separated into a medial portion and a lateral portion;

a lace operable to selectively draw said medial portion and said lateral portion toward one another;

a tongue attached to said upper structure and including a longitudinal axis and a main body opposing said lace;

a first lace-retention feature attached to said main body and defining a first opening receiving said lace in a first direction substantially parallel to a longitudinal axis of said tongue and substantially parallel to said main body; and a second lace-retention feature attached to said main body and defining a second opening receiving said lace in a second direction substantially perpendicular to said longitudinal axis of said tongue and substantially parallel to said main body.

11. The article of footwear of claim 10, wherein a first portion of said lace extends from said medial portion through said first opening and returns to said medial portion and a second portion of said lace extends from said lateral portion through said first opening and returns to said lateral portion.

12. The article of footwear of claim 11, wherein said first portion is spaced apart and separated from said second portion within said first opening.

13. The article of footwear of claim 11, wherein a third portion of said lace extends from said medial portion through said second opening and is received by said lateral portion and a fourth portion extends from said lateral portion through said second opening and is received by said medial portion.

14. The article of footwear of claim 13, wherein said third portion crosses said fourth portion within said second opening.

15. The article of footwear of claim 10, wherein a third portion of said lace extends from said medial portion through said second opening and is received by said lateral portion and a fourth portion extends from said lateral portion through said second opening and is received by said medial portion.

16. The article of footwear of claim 10, wherein said main body includes a first end attached to said vamp and a second end that is movable relative to said vamp.

17. The article of footwear of claim 16, wherein said first lace-retention feature is disposed between said second end and said second lace-retention feature.

18. The article of footwear of claim 16, wherein said second lace-retention feature is disposed between said first end and said first lace-retention feature.

19. A method of making an article of footwear comprising:

attaching a tongue to a vamp having a medial portion and a lateral portion;

attaching a first lace-retention feature to said tongue to define a first opening between a surface of said tongue and said first lace-retention feature;

attaching a second lace-retention feature to said tongue to define a second opening between said surface of said tongue and said second lace-retention feature;

passing a portion of a lace through said first opening in a direction substantially parallel to a longitudinal axis of said tongue; and passing a portion of said lace through said second opening in a direction substantially perpendicular to said longitudinal axis of said tongue.

20. The method of claim 19, wherein passing said lace through said first opening includes passing said lace from said medial portion, through said first opening, and returning said lace portion to said medial portion.

21. The method of claim 19, wherein passing said lace through said second opening includes passing said lace from said medial portion, through said second opening, and to said lateral portion.

* * * * *